US008207491B2

(12) United States Patent
Okumura et al.

(10) Patent No.: US 8,207,491 B2
(45) Date of Patent: Jun. 26, 2012

(54) MASS SPECTROMETER

(75) Inventors: Daisuke Okumura, Kyoto (JP); Hiroto Itoi, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 28 days.

(21) Appl. No.: 12/531,433

(22) PCT Filed: Mar. 23, 2007

(86) PCT No.: PCT/JP2007/000286
§ 371 (c)(1),
(2), (4) Date: Sep. 15, 2009

(87) PCT Pub. No.: WO2008/117333
PCT Pub. Date: Oct. 2, 2008

(65) Prior Publication Data

US 2010/0096541 A1 Apr. 22, 2010

(51) Int. Cl.
*H01J 49/00* (2006.01)

(52) U.S. Cl. ..... 250/281; 250/282; 250/290; 250/292; 250/293

(58) Field of Classification Search ..... 250/281, 250/282, 290, 292, 293
See application file for complete search history.

(56) References Cited

U.S. PATENT DOCUMENTS

2001/0054688 A1* 12/2001 Waki ..... 250/294

FOREIGN PATENT DOCUMENTS

| | | | |
|---|---|---|---|
| DE | 102004048496 | A1 | 4/2006 |
| JP | 03-233844 | A | 10/1991 |
| JP | 08-007827 | A | 1/1996 |
| JP | 11-054085 | A | 2/1999 |
| JP | 2000-149865 | A | 5/2000 |
| JP | 2001-101992 | A | 4/2001 |
| JP | 2001-351563 | A | 12/2001 |

OTHER PUBLICATIONS

Supplementary European Search Report dated Oct. 26, 2011, issued in corresponding European Patent Application No. 07736943.7.

* cited by examiner

*Primary Examiner* — Michael Maskell
(74) *Attorney, Agent, or Firm* — Sughrue Mion, PLLC

(57) ABSTRACT

An electrode member (11, 12) having two electrode plain plate portions (21) and one circular portion (20) is created from a single metal plate, where the two electrode plain plate portions (21) belong to every other virtual rod electrode around the ion optical axis and face across the ion optical axis, and the circular portion (20) electrically connects these two electrode plain plate portions (21). A predetermined number of resin electric holders (13) each holding the electrode member (11, 12) are stacked in the ion optical axis direction, with every other electric member rotated by 90° around the ion optical axis, to form a virtual quadrupole rod type ion guide. Since this configuration reduces the number of components more than ever before and saves a cable for connecting electrode plain plate portions (21, 25) to which the same voltage should be applied, it is possible to reduce the cost and facilitate assembly and regulation in manufacturing and use.

6 Claims, 5 Drawing Sheets

MASS SPECTROMETER

TECHNICAL FIELD

The present invention relates to a mass spectrometer used for a liquid chromatograph mass spectrometer and other apparatuses. More precisely, it relates to an ion transport optical system for transporting an ion or ions into the subsequent stage in a mass spectrometer.

BACKGROUND ART

In a mass spectrometer, an ion transport optical system, which is called an ion lens or ion guide, is used to converge ions sent from the previous stage, and in some cases accelerate them, in order to send them into a mass analyzer such as a quadrupole mass filter in the subsequent stage. One type of such ion transport optical systems conventionally used is a multipole rod type, such as a quadrupole or octapole system. FIG. 10(*a*) is a schematic perspective view of a general quadrupole rod type ion guide.

The ion guide 70 is composed of mutually-parallel four columnar (or tube-like) rod electrodes 71, 72, 73 and 74 which are arranged in such a manner as to surround an ion optical axis C. Generally, the same radio-frequency voltage is applied to two rod electrodes 71 and 73 facing across the ion optical axis C, and a radio-frequency voltage with the same amplitude and a reversed phase as the aforementioned radio-frequency voltage is applied to two rod electrodes 72 and 74 which are provided next to the rod electrodes 71 and 73 in the circumferential direction. The radio-frequency voltages applied as just described form a quadrupole radio-frequency electric field in the space surrounded by the four rod electrodes 71, 72, 73 and 74. In this radio-frequency electric field, ions can be oscillated and converged into the vicinity of the ion optical axis C, and then transported into the subsequent stage.

The applicant of the present patent application has proposed an ion transport optical system using virtual rod electrodes as illustrated in the perspective view of FIG. 10(*b*), as an ion transport optical system taking advantage of the favorable ion-converging capability of the multipole rod type ion guide, while also being capable of accelerating the ions (for example, refer to Patent Document 1 and other documents). In this configuration, the rod electrodes 71, 72, 73 and 74 illustrated in FIG. 10(*a*) are replaced by the virtual rod electrodes 75, 76, 77 and 78, each of which is composed of a plurality (four in the example of this figure) of electrode plain plates 79 arranged along the direction of the ion optical axis C.

In this virtual multipole rod type ion transport optical system, different voltages can be respectively applied to the four electrode plain plates 79 constituting one virtual rod electrode 75, 76, 77 or 78. Therefore, a direct current voltage which increases in a stepwise fashion toward the ion's traveling direction may be superimposed on the radio-frequency voltage in order to accelerate or, inversely, decelerate ions while they are passing through the space surrounded by the virtual rod electrodes 75, 76, 77 and 78. In addition, as illustrated in FIG. 10(*c*), the electrode plain plates 79 composing the virtual rod electrodes may be arranged so that they approach the ion optical axis C in a stepwise fashion along the ion's traveling direction in order to gradually narrow down the ion stream while converging it.

Although an ion transport optical system using virtual rod electrodes has excellent properties as just described, at the same time it also has disadvantages: since a rod which can be originally composed of one rod electrode is segmented into a plurality of electrode plain plates, the number of components is inevitably increased, which unavoidably leads to a cumbersome assembly and regulation in manufacturing and use. To solve these problems, the applicant of the present patent application has proposed a concrete configuration of a multipole rod type ion guide using a virtual rod electrode in Patent Document 2.

In the configuration disclosed in this document, one electrode plain plate has a slightly long shape with an arc-shaped end which faces the ion optical axis when the plate is completed. Four electrode plain plates which are arranged in a plane orthogonal to the ion optical axis in such a manner as to surround the ion optical axis form a single group, and four groups of electrode plain plates, i.e. sixteen electrode plain plates, which arranged in the ion optical axis direction to form the four virtual rod electrodes are screwed onto an insulating holder made of a synthetic resin. The electrode plain plates, to which the same voltage is applied, arranged to face across the ion optical axis in a plane orthogonal to the ion optical axis are connected by a short-circuiting line. Unitizing the main components including the electrode plain plates in this manner facilitates the handling of the components and reduces the time and labor for their assembly and regulation.

The number of electrode plain plates required in this configuration equals the total number of virtual rod electrodes multiplied by the total number of electrode plain plates constituting a virtual rod electrode. The number of components may not be serious for a quadrupole. However, with an increase of the number of poles, as in the case of a hexapole and octapole, the number of components increases, which leads to cumbersome assembly and regulation. This problem also arises in the case where the number of electrode plain plates constituting a virtual rod electrode is increased to ten, twenty or more for example. Given this factor, it is desired to further decrease the number of components and simplify the assembly and regulation. Furthermore, in the case where the individual electrode plain plates are individually screwed onto a holder, a subtle error in their relative position may occur, which might negatively affect the ions' convergency, i.e. ions' passage efficiency.

[Patent Document 1] Japanese Unexamined Patent Application Publication No. 2000-149865

[Patent Document 2] Japanese Unexamined Patent Application Publication No. 2001-351563

DISCLOSURE OF THE INVENTION

Problems to be Solved by the Invention

The present invention has been achieved to solve the aforementioned problems, and the chief objective thereof is to provide a mass spectrometer having a virtual multipole rod type ion transport optical system which facilitates the assembly in manufacturing and the regulation in both manufacturing and use.

Means for Solving the Problems

To solve the previously described problems, the present invention provides a mass spectrophotometer having a virtual multipole rod type ion transport optical system in which 2n (where n is an integer equal to or more than two) virtual rod electrodes, each of which is composed of m (where m is an integer equal to or more than two) electrode plain plate portions which are mutually separated in the ion optical axis direction, are provided in such a manner as to surround the ion optical axis, wherein:

n electrode plain plate potions belonging to every other virtual rod electrode around the ion optical axis and being provided in a plane orthogonal to the ion optical axis, and a connection connector portion for electrically connecting these n electrode plain plate portions, are integrated with a conducting plate to form an electrode member, and 2m electrode members are arranged in such a manner as to be mutually separated in the ion optical axis direction to form the virtual multipole rod type ion transport system.

Generally in a multipole rod type ion transport optical system, different voltages are respectively applied to two electrodes neighboring in the circumferential direction. For example, in the case where a composite voltage of $V+v\cdot\cos\omega t$ in which a radio-frequency voltage $v\cdot\cos\omega t$ is superimposed on a direct current bias voltage V is applied to one electrode, a composite voltage of $V-v\cdot\cos\omega t$ in which a radio-frequency voltage $-v\cdot\cos\omega t$ having a phase opposite to that of the aforementioned radio-frequency voltage $v\cdot\cos\omega t$ is superimposed on the same direct current bias voltage V is applied to the other electrode. In the mass spectrometer according to the present invention, n electrode plain plate portions that are alternately located around the ion optical axis are provided in one electrode member, and the electrode plain plate portions adjacent around the ion optical axis are provided on another electrode member. That is, only n electrode plain plate portions to which the same voltage is applied are provided in the same electrode member. Therefore, by applying a predetermined voltage to each electrode member, it is possible to form an appropriate radio-frequency electric field, or a composite electric field in which a radio-frequency electric field is superimposed on a direct current electric field, in the space surrounded by the 2n virtual rod electrodes. In addition, since a plurality of electrode plain plate portions and a connector portion for connecting these electrode plain plate portions to each other are unitized, the number of components can be decreased.

For example, n=2 in a virtual quadrupole rod type ion transport optical system, and n=4 in a virtual octapole rod type ion transport optical system. In the mass spectrometer according to the present invention, the number of electrode members to be prepared has no relation to the number of poles, 2n, of the virtual multipole rod type ion transport optical system. Therefore, even if the number of poles is increased, the number of electrode members to be prepared remains unchanged as long as the number of electrode plain plate portions constituting one virtual rod electrode does not change. Accordingly, the mass spectrometer according to the present invention has an advantage in that the number of components for the virtual multipole rod type ion transport optical system can be suppressed. This suppression effect of the number of components is particularly significant in the case where the number of poles is large.

In a preferable embodiment of the mass spectrometer according to the present invention, the electrode member has a shape in which the electrode plain plate portions extend inward from an inside edge end of the connector portion shaped as a loop or partially cut loop. For example, the loop may have a circular shape. In the electrode plain plate portion, the edge facing inwards, i.e. toward the ion optical axis, may preferably have a shape of an arc or hyperbola for example.

In the multipole rod type ion transport optical system, the angles between the two rod electrodes adjacent around the ion optical axis are identical. Therefore, two electrode members adjacent in the ion optical axis direction, each having electrode plain plate portions belonging to different virtual rod electrodes (and being adjacent around the ion optical axis), can be obtained with two identical configurations, in which one of the two is rotated around the ion optical axis by a predetermined angle to the other. That is, only one kind of electrode member needs to be manufactured. Therefore, the cost in manufacturing electrode members can be reduced, which leads to an inexpensive production of a virtual multipole rod type ion transport optical system.

In the mass spectrometer according to the present invention, each of the electrode members may be held by an insulating holding member inserted between two electrode members adjacent in the ion optical axis direction to separate them by a predetermined distance.

With this configuration, a virtual multipole rod type ion transport optical system can be easily configured by aligning in piles the holding members, each holding an electrode member, in the ion optical axis direction. In doing so, the distance between the adjacent electrode members is determined by the thickness of the holding member in the ion optical axis direction. Therefore, the electrode members can be accurately positioned. The number of electrode plain plate portions constituting the virtual rod electrode can be changed by varying the number of holding members to be aligned, which can be easily performed. Thus, it is possible to compose a virtual multipole rod type ion transport optical system with any number of stages.

In the previously described conventional virtual multipole rod type ion transport optical system, 2n electrode plain plates each belonging to one of the 2n virtual rod electrodes are constantly included in a plane orthogonal to the ion optical axis. On the other hand, in the mass spectrometer according to the present invention, in the case of a plane-shaped electrode member, the electrode plain plate portions belonging to the virtual rod electrodes adjacent around the ion optical axis are not included in a plane orthogonal to the ion optical axis but are out of alignment in the ion optical axis direction. However, this electrode configuration hardly influences the radio-frequency electric field formed in the space surrounded by the virtual rod electrodes, particularly in the vicinity of the ion optical axis, so that the system can exhibit a sufficient ion convergence performance.

In the case where the direct current voltage to be applied is changed for every stage in order to increase the ions' convergence performance or accelerate or decelerate ions, it is advantageous that the electrode plain plate portions belonging to the virtual rod electrodes adjacent around the ion optical axis exist in a plane orthogonal to the ion optical axis. Given this factor, in the mass spectrometer according to the present invention, it is preferable that:

the 2m electrode members are composed of m first electrode members in which the electrode plain plate portion and the connector portion are in the same plane and m second electrode members in which the electrode plain plate portion and the connector portion are not in the same plane; and the first electrode members and the second electrode members are alternately arranged in the ion optical axis direction so that the total of 2n electrode plain plate portions each belonging to one of the virtual rod electrodes are placed in a plane orthogonal to the ion optical axis.

Effects of the Invention

In the mass spectrometer according to the present invention, the electrode plain plate portions to which the same voltage is applied in a plane orthogonal to the ion optical axis and the connector portion which corresponds to a connection wire (e.g. a cable) are formed in one conductive plate as an electrode member. Therefore, regardless of the number of poles, it is sufficient to prepare two times as many as the number m, i.e. 2m, of electrode plain plate portions constituting one virtual rod electrode. This decreases the number of components constituting a virtual multipole rod type ion transport optical system, and facilitates the assembly and regulation in manufacturing and use. In particular, the mass spectrometer according to the present invention is advantageous for increasing the number of poles since the cost and the ease of assembly do not change with the increase in the number of poles. Furthermore, all the 2m electrode members to be prepared can have the identical configuration, which is also advantageous in reducing the cost.

EXPLANATION OF NUMERALS

1 . . . Nozzle
2 . . . Sampling Cone
3 . . . Fist Ion Lens
4 . . . Second Ion Lens
5 . . . First-Stage Quadrupole
6 . . . Collision Cell
7 . . . Second-Stage Quadrupole
8 . . . Third-Stage Quadrupole
9 . . . Ion Detector
C . . . Ion Optical Axis
11, 15 . . . First Electrode Member
12 . . . Second Electrode Member
13 . . . Electrode Holder
14 . . . Fixing Bolt
20, 24 . . . Circular Portion
21, 25, 41 . . . Electrode Plain Plate Portion
22, 26 . . . Terminal Portion
23, 27 . . . Circular Aperture
30 . . . Circular Portion
31 . . . Flange
32 . . . Notch
33 . . . Bolt Insertion Hole

BEST MODE FOR CARRYING OUT THE INVENTION

Figure 1:
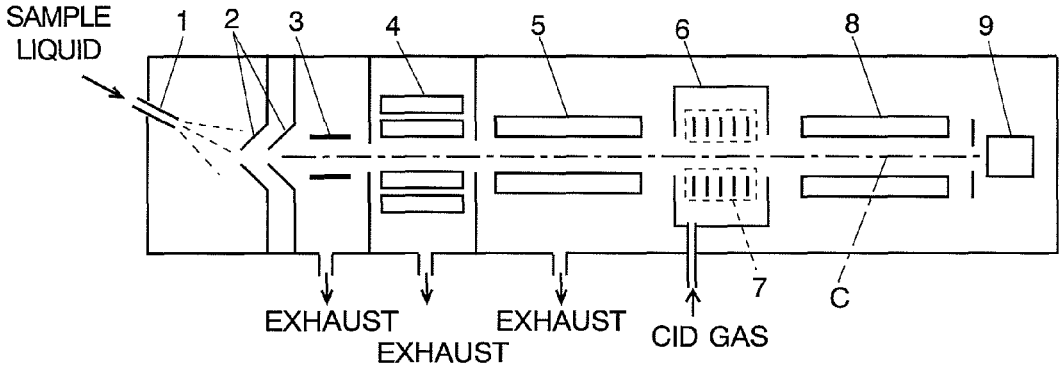
FIG. 1 is a configuration diagram of the main portion of the MS/MS mass spectrometer of an embodiment of the present invention.

An MS/MS (or tandem) mass spectrometer which is an embodiment of the mass spectrometer according to the present invention will be described with reference to figures. FIG. 1 is a configuration diagram of the main portion of the MS/MS mass spectrometer of this embodiment.

A liquid chromatograph is provided in the previous stage of this mass spectrometer, and a liquid sample which has been separated into components in a column of the liquid chromatograph is introduced into a nozzle 1. The sample liquid is supplied with biased charges from the nozzle 1 and eventually atomized (or electro sprayed) into a space at substantially atmospheric pressure. When the solvent contained in the droplets of the sprayed liquid vaporizes, a variety of components included in the sample are ionized and sent into the subsequent stage through a sampling cone 2. These ions are converged, and accelerated in some cases, while passing through the first ion lens 3 and the second ion lens 4 to be introduced into the first-stage quadrupole 5. Even though ions having a variety of masses are introduced into the first-stage quadrupole 5, only a target ion having a specific mass (mass-to-charge ratio to be exact) selectively passes through the first-stage quadrupole 5 and is sent into the collision cell 6 in the subsequent stage, while other ions are dispersed along the way.

A predetermined collision-induced dissociation (CID) gas such as Ar gas is introduced into the collision cell 6. While passing through the electric field formed by the second-stage quadrupole 7 provided inside the collision cell 6, the target ion is dissociated if it collides with the CID gas. That is, the target ion selected in the first-stage quadrupole 5 performs as a precursor ion and a variety of product ions are produced. These variety of product ions and target ions which have not been dissociated exit from the collision cell 6 and are introduced into the third-stage quadrupole 8. Only the product ions having a specific mass selectively pass through the third-stage quadrupole 8 and are sent into the ion detector 9, while other ions are dispersed along the way. As just described, only the product ions having a specific mass reach the ion detector 9, and the detection signal in accordance with the amount of the ions is produced. The mass of the product ion to be selected in the third-stage quadrupole 8 can be changed by varying the voltage applied to the third-stage quadrupole 8. The mass of the ion, i.e. precursor ion, to be selected in the first-stage quadrupole 5 can also be changed by varying the voltage applied to the first-stage quadrupole 5.

The pathway in which ions pass from the nozzle 1 through the ion detector 9 is partitioned into a plurality of chambers. These chambers are evacuated so that the degree of vacuum is increased in a stepwise fashion from the first-stage ionization chamber where the nozzle 1 is provided, to the analysis chamber where the quadrupoles 5, 7 and 8 and the ion detector 9 are provided. However, since the CID gas is supplied almost continuously into the collision cell 6, the gas pressure in the collision cell 6 is relatively high even inside the high vacuum analysis chamber. Accordingly, an ion that has collided with the CID gas in the collision cell 6 is likely to change its traveling direction and disperse. Nevertheless, ions are delivered into the subsequent stage while being appropriately converged in the vicinity of the ion optical axis C by the electric field formed by the second-stage quadrupole 7. As this second-stage quadrupole 7, the mass spectrometer according to the present invention utilizes a virtual quadrupole rod type ion guide having a characteristic configuration which will be described later.

Figure 2:
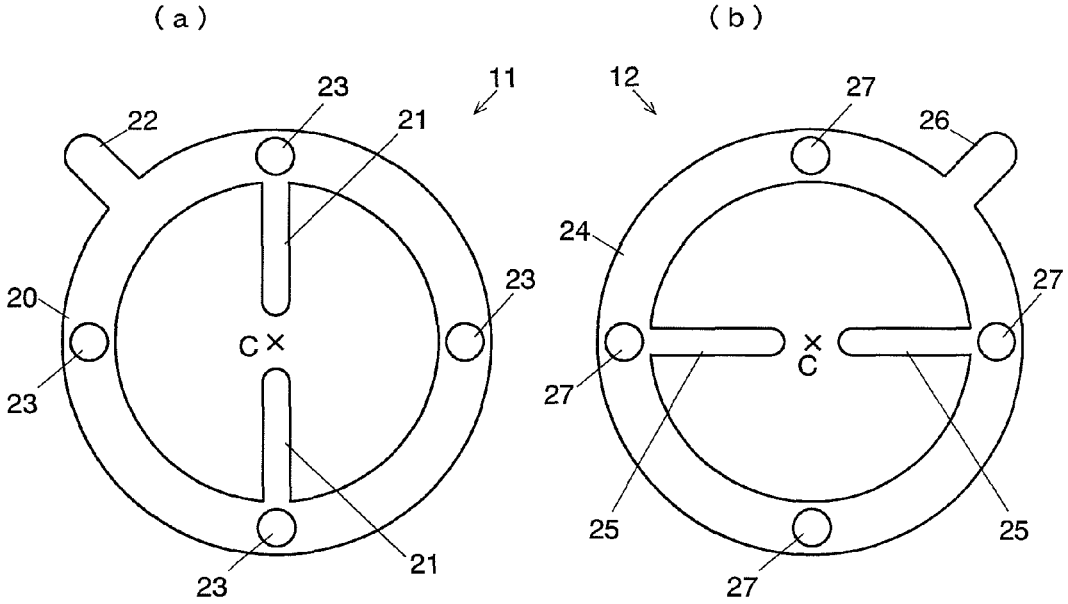
FIG. 2 is a plain view of an electrode member for constituting a virtual quadrupole rod type ion guide provided inside a collision cell.

Next, the detailed configuration of this virtual quadrupole rod type ion guide will be described with reference to FIGS. 2 through 5. This virtual quadrupole rod type ion guide includes, as its main components, electrode members 11 and 12, and an electrode holder 13. FIG. 2 is a plain view of the first electrode member 11 and the second electrode member 12, each viewed from the direction parallel to the ion optical axis C.

The first electrode member 11 illustrated in FIG. 2(*a*) is formed by processing one metal plate (or other conductive plate member), and includes: a circular portion 20 whose center is the ion optical axis C; a pair of electrode plain plate portions 21 each extending inward, i.e. toward the ion optical axis C, from the top and bottom of the inner edge of the circular portion 20; and a terminal portion 22 extending outward from diagonally upper left of the outer edge of the circular portion 20. In the circular portion 20, four circular apertures 23 are bored at 90° intervals. The electrode plain plate portion 21 has a long and thin shape with an arc-shaped edge facing the ion optical axis C, and the arc-shaped edges of the two electrode plain plate portions 21 oppositely face each other across the ion optical axis C.

The second electrode member 12 illustrated in FIG. 2(*b*) is a member having the identical shape to that of the first electrode member 11, and obtained by rotating the first electrode member 11 by 90° clockwise in FIG. 2 around the ion optical axis C. It should be noted that the portions in FIG. 2(*b*) are denoted by different numerals for the sake of the distinction from those shown in FIG. 2(*a*).

Figure 3:
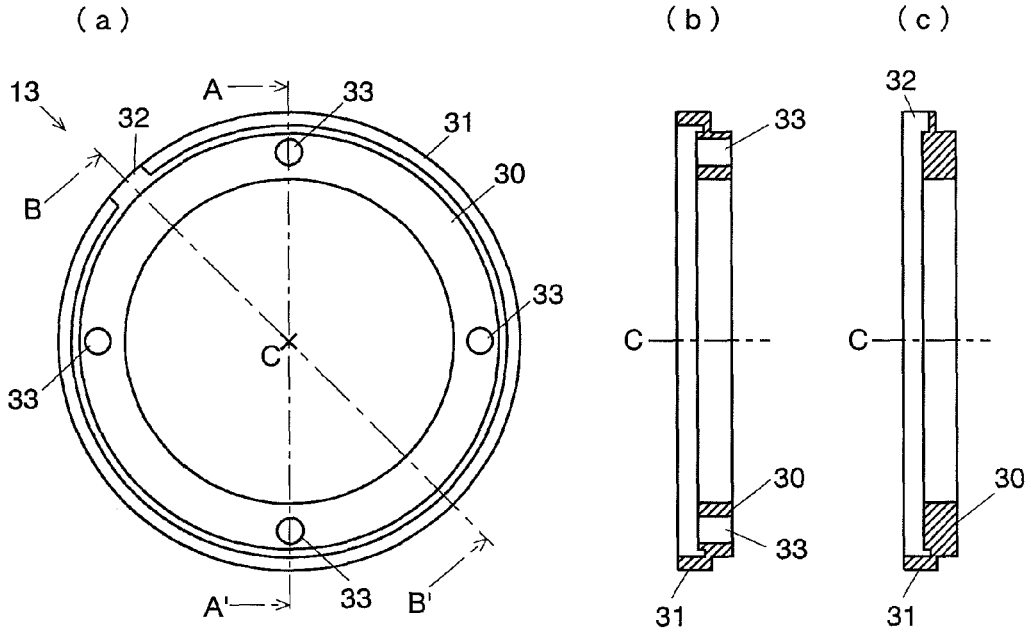
FIG. 3(*a*) is a plain view of an electrode holder for constituting a virtual quadrupole rod type ion guide, FIG. 3(*b*) is a sectional view at line A-A', and FIG. 3(*c*) is a sectional view at line B-B'.

FIG. 3(*a*) is a plain view of the electrode holder 13 viewed from the direction parallel to the ion optical axis, FIG. 3(*b*) is a sectional view at line A-A' in FIG. 3(*a*), and FIG. 3(*c*) is a sectional view at line B-B' in FIG. 3(*a*). The electrode holder 13 is made of a synthetic resin (or another insulant), such as Teflon (a trademark of DuPont), having insulation properties, and includes: a circular portion 30 having a thickness in the ion optical axis C direction; and a flange 31 projecting outward with a substantially L-shaped cross section from the outer edge of the circular portion 30. A notch 32 having a predetermined width is formed in a portion in the circumferential direction of the flange 31. The circular portion 30 has four bolt insertion holes 33 at angular intervals of 90°. The inside diameter of the bolt insertion hole 33 is somewhat smaller than that of the circular apertures 23 and 27 of the electrode members 11 and 12. The diameter of the inner edge of the flange 31 is substantially equal to or slightly larger than that of the circular portions 20 and 24 of the electrode members 11 and 12. The width of the notch 32 is slightly larger than that of the terminal portions 22 and 26.

Figure 4:
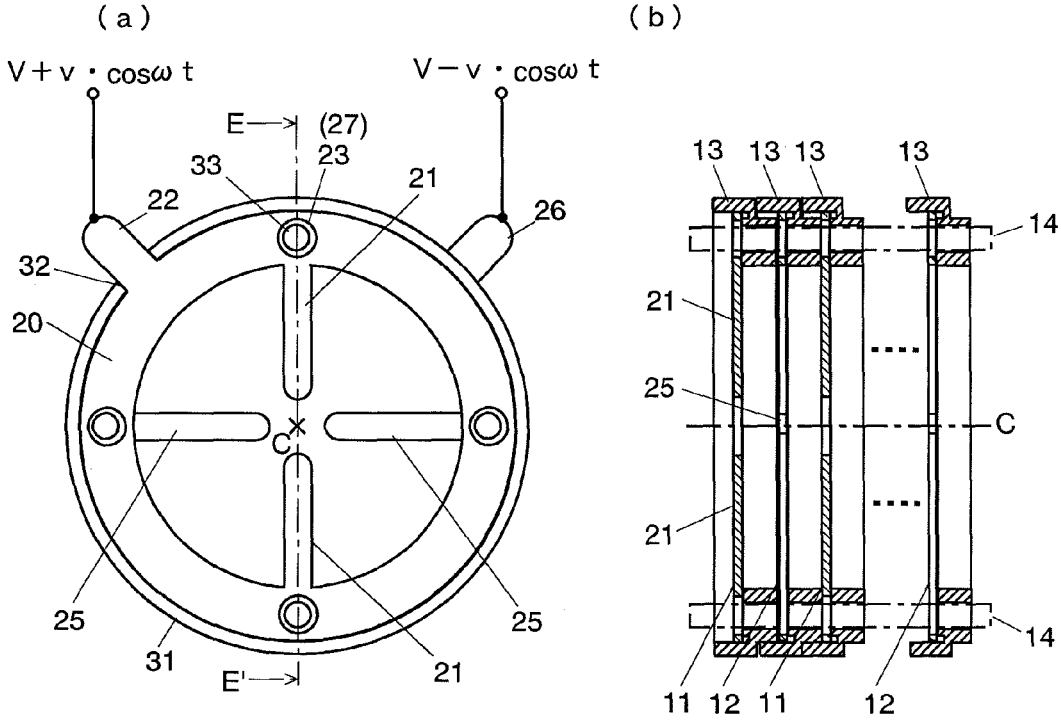
FIG. 4(*a*) is a plain view of an electrode holder with electrode members fixed thereon, and FIG. 4(*b*) is a longitudinal sectional view of the same.
Figure 5:
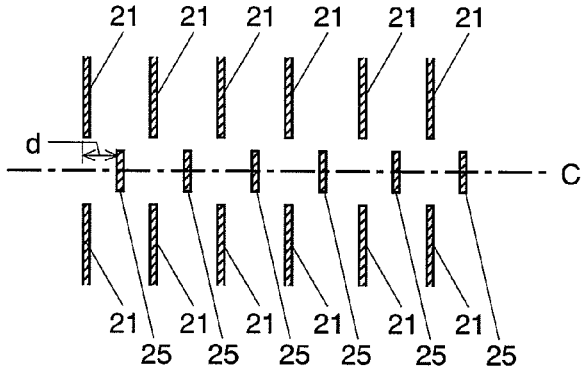
FIG. 5 is a longitudinal sectional view of the main portion illustrating the electrode arrangement of a virtual quadrupole rod type ion guide.

FIG. 4(*a*) is a plain view of a virtual quadrupole rod type ion guide, which is composed of the electrode portions 11 and 12, and the electrode holder 13, viewed from the direction parallel to the ion optical axis C. FIG. 4(*b*) is a longitudinal sectional view at line E-E' in FIG. 4(*a*). FIG. 5 is a longitudinal sectional view of the main portion illustrating the electrode arrangement of a virtual quadrupole rod type ion guide.

The first electrode member 11 is fitted into the flange 31 in such manner that the terminal portion 22 corresponds to the aforementioned notch 32 of the electrode holder 13, to make one electrode holder 13 hold one first electrode member 11. In this state, both the center of the circular aperture 23 of the first electrode member 11 and the center of the bolt insertion hole 33 of the electrode holder 13 are placed on the same line parallel to the ion optical axis C. In the meantime, by rotating another electrode holder 13 about the ion optical axis C by 90° clockwise in FIG. 3(*a*), the position of the notch 32 corresponds to the position of the terminal portion 26. Hence, the second electrode member 12 is fitted into the flange 31 in the same manner as the first electrode member 11.

The electrode holders 13 holding the first electrode member 11 and the electrode holders 13 holding the second electrode member 12 as just described are alternately aligned in the direction of the ion optical axis C, and the adjacent electrode holders 13 are tightly attached as illustrated in FIG. 4(*b*). In doing so, the circular portions 20 and 24 of the first and second electrode members 11 and 12 are sandwiched between the flange 31 of the two adjacent electrode holders 13. A predetermined number of electrode holders 13 holding the electrode member 11 or 12 are stacked in the direction of the ion optical axis C to form a virtual quadrupole rod type ion guide.

In stacking a plurality of electrode holders 13 in this manner, the bolt insertion holes 33 of the electrode holders 13 and the circular apertures 23 of the electrode members 11 and 12 are aligned on a line parallel to the ion optical axis C at every 90° position on the circumference. Then, as illustrated in FIG. 4(*b*), each of the four fixing bolts 14 is inserted into the bolt insertion hole 33 in the direction parallel to the ion optical axis C in order to fix the plurality of electrode holders 13 with the electrode members 11 and 12 sandwiched in between. Since the inside diameter of the circular aperture 23 is larger than that of the bolt insertion hole 33, when the metallic fixing bolt 14 is inserted into the bolt fixing aperture 33, the bolt 14 does not touch the electrode members 11 and 12, which assures the insulation therebetween.

Figure 10:
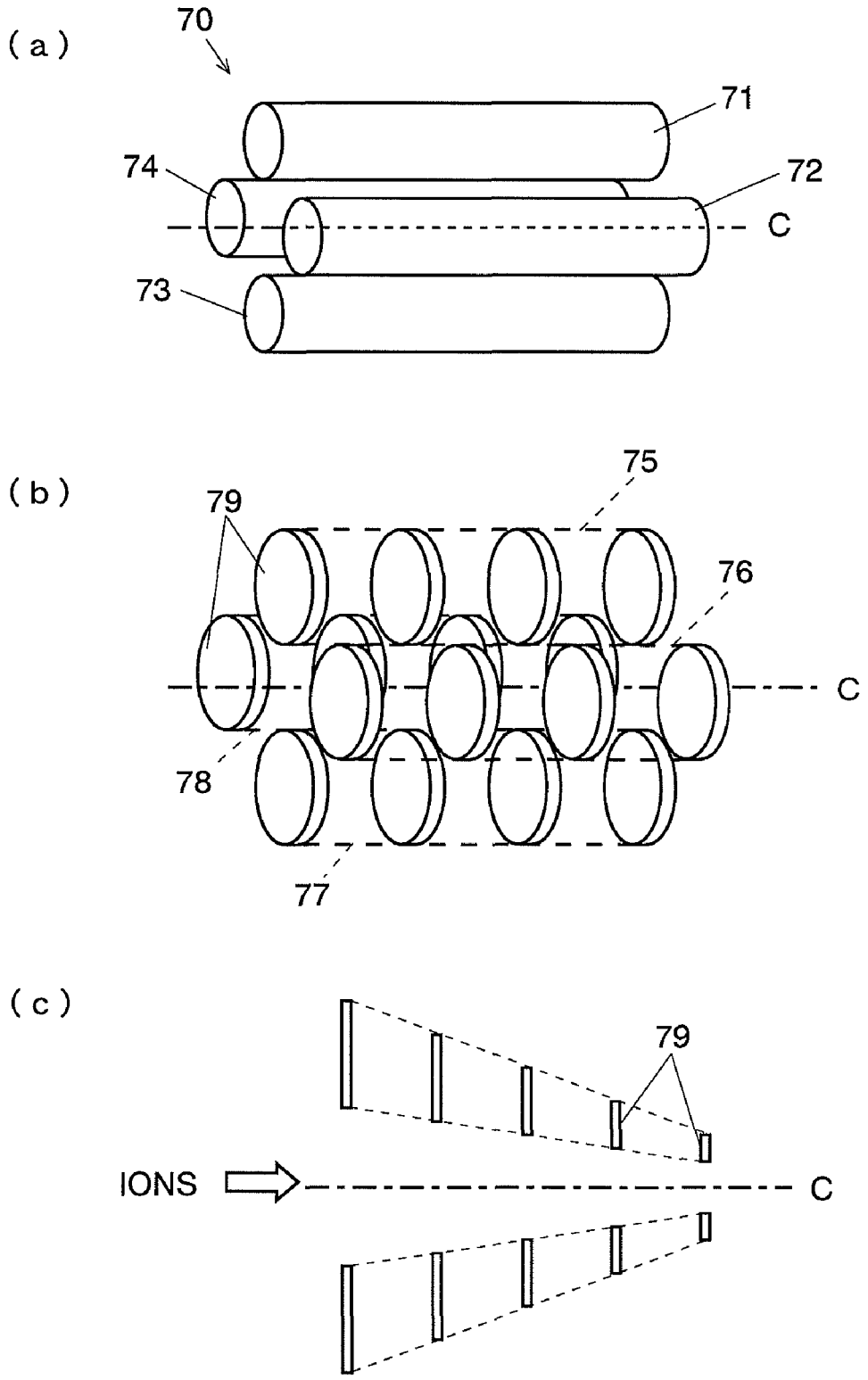
FIG. 10 illustrates a variety of schematic configuration diagrams of conventional multipole rod type ion guides.

Since the first electrode member 11 and the second electrode member 12 are obtained by rotating against each other by 90° around the ion optical axis C, a total of four electrode plain plates portions 21 and 25 provided on one first electrode member 11 and one second electrode member 12 adjacent thereto in the direction of the ion optical axis C are 90°-symmetrically arranged around the ion optical axis C as illustrated in FIG. 4(*a*), and the edges facing the ion optical axis C are all arc shaped. These four electrode plain plate portions 21 and 25 form the four poles of a quadrupole. Although these four poles do not exist in a plane orthogonal to the ion optical axis C (but exist in the positions out of alignment in the direction of the ion optical axis C), they substantially bring about the same effect as four electrode plain plates existing in a plane orthogonal to the ion optical axis C in the conventional virtual quadrupole rod type ion guide illustrated in FIG. 10(*b*). The four-stage configuration as illustrated in FIG. 10(*b*) can be realized by preparing four electrode holders 13 holding the first electrode member 11 and four electrode holders 13 holding the second electrode member 12, and alternately aligning them in the direction of the ion optical axis C.

Figure 6:
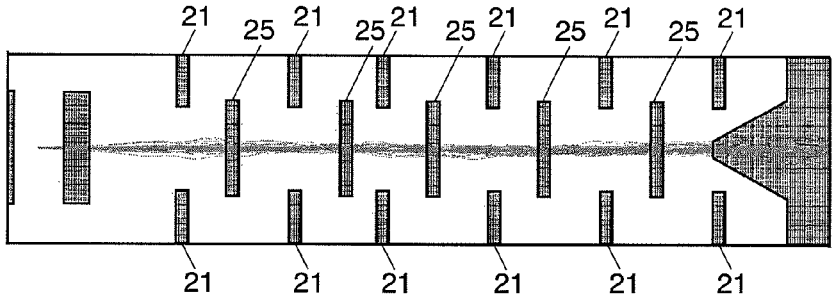
FIG. 6 is a diagram illustrating a simulation result of ions' passage mode inside a virtual quadrupole rod type ion guide.

FIG. 6 shows a six-stage configuration in which six electrode holders 13 holding the first electrode member 11 and the six electrode holders 13 holding the second electrode member 12 are alternately disposed. The electrode plain plate portion 21 of the first electrode member 11 and the electrode plain plate portion 25 of the second electrode member 12 are spaced from each other in the direction of the ion optical axis C by a distance d, which is determined by the thickness of the electrode holder 13. In other words, it is possible to accurately determine the distance d between the electrode plain plate portion 21 and the electrode plain plate portion 25 by the thickness of the electrode holder 13. A set of six electrode plain plate portions 21 or 25 aligned in the direction of the ion optical axis C forms one virtual rod electrode, and four virtual rod electrodes are placed around the ion optical axis C to form a virtual quadrupole rod type ion guide.

For this virtual quadrupole rod type ion guide, a composite voltage of $V+v\cdot\cos\omega t$ for example in which a radio-frequency voltage $v\cdot\cos\omega t$ is superimposed on a direct current bias voltage V is applied to the six first electrode members 11, and a composite voltage of $V-v\cdot\cos\omega t$ for example in which a radio-frequency voltage $-v\cdot\cos\omega t$ is superimposed on a direct current bias voltage V is applied to the six second electrode members 12. These voltages can be supplied, as illustrated in FIG. 4(*a*), from the terminal portions 22 and 26 projecting outward from the outer edge of the electrode holder 13. The application of the aforementioned voltages forms a radio-frequency electric field in the space surrounded by the four virtual rod electrodes which are composed of the electrode plain plate portions 21 and 25, and therefore it is possible to transport ions into the subsequent stage while converging them in the vicinity of the ion optical axis C.

FIG. 6 is a diagram illustrating a simulation result of ions' passage mode inside the virtual quadrupole rod type ion guide illustrated in FIG. 5. As previously described, in this virtual quadrupole rod type ion guide, the electrode plain plates 21 and 25 forming the quadrupole are not in the same plane. However, as is understood from FIG. 6, ions do not disperse but are transported while being converged in the vicinity of the ion optical axis C, which achieves a high level of ion transport efficiency.

Instead of applying the same composite voltage to each of the six first electrode members 11 and six second electrode members 12, the direct current voltage may be changed in a stepwise fashion in the direction of the ion optical axis C to accelerate or decelerate ions by a potential gradient of the direct current electric field.

As previously described, in the virtual quadrupole type ion guide in the mass spectrometer of the present embodiment, a pair of electrode plain plate portions, to which the same voltage is applied and which faces each other across the ion optical axis C, and the connector portion for connecting them are formed with one metal plate, and an ion guide can be formed by stacking a plurality of electrode holders with the metal plates held therein and fixing these holders with bolts. Therefore, it has the advantages of simple structure, small number of components, easy assembly, and easy regulation in manufacturing and use. Furthermore, the number of stages, i.e. the number of electrode plain plate portions constituting one virtual rod electrode can be easily changed.

Figure 7:
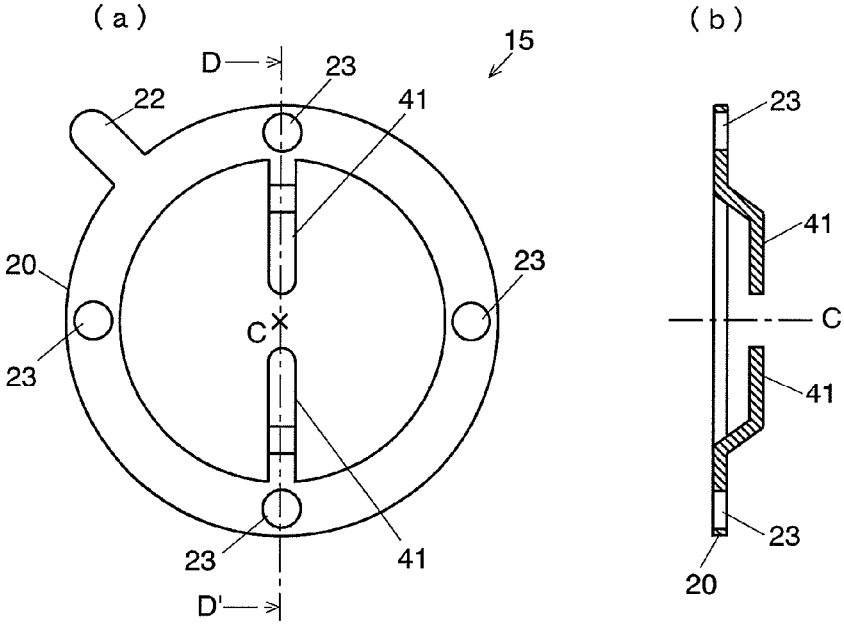
FIG. 7(*a*) is a plain view of an electrode member for constituting a virtual quadrupole rod type ion guide in a mass spectrometer of another embodiment, and FIG. 7(*b*) is a sectional view at line D-D'.

In the configuration of the aforementioned embodiment, the four poles do not exist in the same plane orthogonal to the ion optical axis C. This configuration can be modified so that the four poles will be disposed in a plane orthogonal to the ion optical axis C in the following manner: the second electrode member 12 as illustrated in FIG. 2(*b*) is used without modification, and the first electrode member illustrated in FIG. 7 having a slightly different shape from that in the aforementioned embodiment is used. In the first electrode member 15, an electrode plain plate portion 41 which extends inward from the inner edge of the circular portion 20 is hooked in the middle thereof, and the inner portion of the electrode plain plate portion 41 is parallel to and out of alignment with the circular portion 20.

Figure 8:
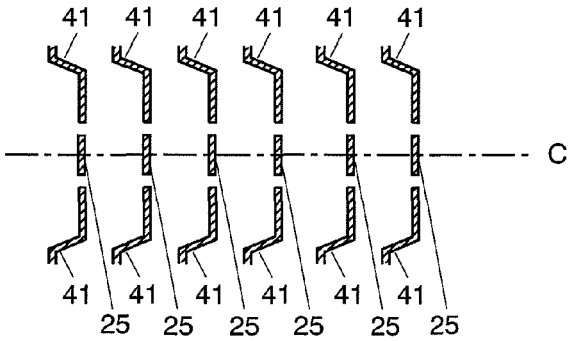
FIG. 8 is a longitudinal sectional view of the main portion illustrating the electrode arrangement in a virtual quadrupole rod type ion guide of another embodiment.

Accordingly, when a plurality of electrode holders 13 are stacked in the direction of the ion optical axis C with the first electrode member 15 held by the electrode holder 13 as in the aforementioned embodiment, the inner portion of the electrode plain plate portion 41 of the first electrode member 15 and the electrode plain plate portion 25 of the second electrode member 12 are placed in a plane orthogonal to the ion optical axis C. They have the arrangement as in the sectional view illustrated in FIG. 8.

Figure 9:
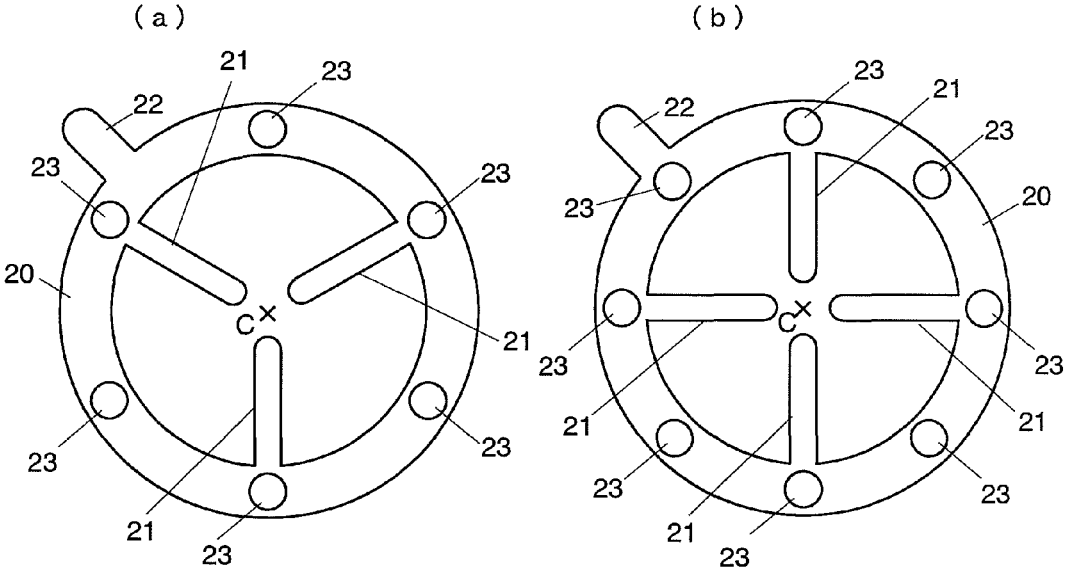
FIG. 9 is a plain view of an electrode member for constituting a virtual quadrupole rod type ion guide in a mass spectrometer of another embodiment.

Although a virtual quadrupole rod type ion guide is used in the aforementioned embodiment, the number of poles can be easily increased to be hexapole, octapole, and so on. For example, a virtual hexapole rod type ion guide can be created by using an electrode member having a shape as illustrated in FIG. 9(*a*) in which electrode plain plate portions 21 extend at 120° intervals around the ion optical axis C from the inner edge of the circular portion 20. Similarly, a virtual octapole rod type ion guide can be created by using an electrode member having a shape as illustrated in FIG. 9(*b*) in which electrode plain plate portions 21 extend at 90° intervals around the ion optical axis C from the inner edge of the circular portion 20. As the second electrode member, the aforementioned first electrode member can be used by rotating 60° or 45° respectively around the ion optical axis C.

In the aforementioned embodiment, a virtual multipole rod type ion guide which is characteristic of the present invention is used in a collision cell. However, it can be used in a variety of portions in which conventionally an ion transport optical system such as an ion guide or ion lens has been used. For example, in the MS/MS mass spectrometer illustrated in FIG. 1, a virtual multipole rod type ion guide can also be used for the first ion lens 3 or the second ion lens 4. As a matter of course, it can be used not only in an MS/MS type, but can be used as an ion transport optical system in a variety of mass spectrometers.

The invention claimed is:

1. A mass spectrometer having a virtual multipole rod type ion transport optical system in which 2n (where n is an integer equal to or more than two) virtual rod electrodes composed of m (where m is an integer equal to or more than two) electrode plain plate portions which are mutually separated in an ion optical axis direction are provided in such a manner as to surround the ion optical axis, wherein n electrode plain plate portions belonging to every other virtual rod electrode around the ion optical axis and being provided in a plane orthogonal to the ion optical axis, and a connector portion for electrically connecting these n electrode plain plate portions are integrated into an electrode member made from a single conducting plate, and 2m electrode members are arranged in such a manner as to be mutually separated in the ion optical axis direction to form the virtual multipole rod type ion transport system.

2. The mass spectrometer according to claim 1, wherein the electrode member has a shape in which the electrode plain plate portion extends inward from an inside edge end of the connector portion which is substantially loop shaped.

3. The mass spectrometer according to claim 2, wherein each of the electrode members is held by an insulating holding member inserted for separating two electrode members adjacent in the ion optical axis direction.

4. The mass spectrometer according to claim 2, wherein:

the 2m electrode members are composed of m first electrode members in which the electrode plain plate portion and the connector portion are in a same plane and m second electrode members in which the electrode plain plate portion and the connector portion are not in a same plane; and the first electrode members and the second electrode members are alternately arranged in the ion optical axis direction so that each of the total of 2n electrode plain plate portions belonging to each virtual rod electrode is placed in a plane orthogonal to the ion optical axis.

5. The mass spectrometer according to claim 2 wherein, in the electrode plain plate portion, an edge facing toward the ion optical axis has a shape of an arc.

6. The mass spectrometer according to claim 2 wherein, in the electrode plain plate portion, an edge facing toward the ion optical axis has a shape of a hyperbola.

* * * * *